United States Patent [19]

Tiraspolsky et al.

[11] 4,011,917

[45] Mar. 15, 1977

[54] PROCESS AND UNIVERSAL DOWNHOLE MOTOR FOR DRIVING A TOOL

[76] Inventors: Wladimir Tiraspolsky, 69 au VichnBrenson, 92130 Issy-les-Moulineaux, France; Roger Francois Rouviere, Quartier les Ribel, 13770 Venelles, France

[22] Filed: Mar. 29, 1976

[21] Appl. No.: 671,494

Related U.S. Application Data

[63] Continuation of Ser. No. 498,701, Aug. 19, 1974, abandoned.

[52] U.S. Cl. ..... 175/107; 418/88

[51] Int. Cl.[2] ..... E21B 3/12

[58] Field of Search ..... 175/57, 99, 107; 418/17, 48, 49; 415/502, 503

[56] References Cited

UNITED STATES PATENTS

| | | | |
|---|---|---|---|
| 2,898,087 | 8/1959 | Clark | 175/99 |
| 3,112,801 | 12/1963 | Clark et al. | 175/107 |
| 3,443,482 | 5/1969 | Lummus et al. | 418/48 |
| 3,489,231 | 1/1970 | Garrison et al. | 418/48 |
| 3,603,407 | 9/1971 | Cark | 175/6 |
| 3,838,949 | 10/1975 | Makino | 418/48 |
| 3,840,080 | 10/1974 | Berryman | 175/107 |

*Primary Examiner*—James A. Leppink
*Attorney, Agent, or Firm*—Young & Thompson

[57] ABSTRACT

The process enables, while starting from the same basical members, assembled in two different arrangements, to drive an earth-boring tool such as a bit, a milling cutter, a core barrel or the like with a reduced speed or a fast speed, according to the prevailing boring conditions. The downhole motor comprises a shaft and a body constituted by two helicoidal gears arranged within each other, providing an encapsulation preferably of right-handed pitch and having K and K+1 teeth. For providing a reduced speed the body is rotatably mounted and the tool is connected to said body. The shaft is angularly fixed and free to undergo a nutation movement. The resulting speed is the relative speed of rotation between the said body and the said shaft. For providing a fast rotation speed, the body is angularly and radially fixed. The helicoidal shaft meshes with the body and is supported in order freely to rotate around a crank system. The tool is connected to the crank.

18 Claims, 7 Drawing Figures

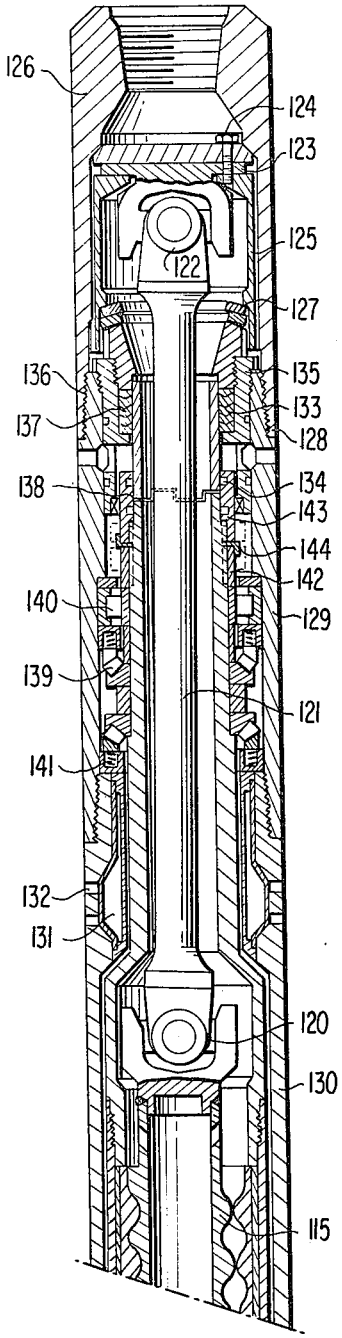
FIG. 7
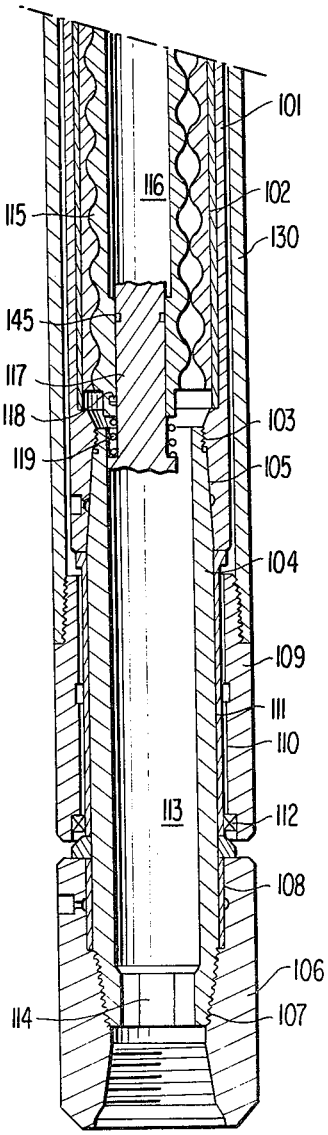

PROCESS AND UNIVERSAL DOWNHOLE MOTOR FOR DRIVING A TOOL

This is a continuation, of application Ser. No. 498,701, filed Aug. 19, 1974 now abandoned.

The present invention relates to a process for driving earth-boring tools, a downhole motor for driving such tools, and core drill assemblies employing such motors.

The most rational method of driving a bottom hole tool, such as a rock bit, a milling cutter or a core drill crown, would logically be a motor coupled directly to the tool. This has been understood for a century but, nevertheless, downhole motors have not at the present time captured more than a small percentage of the world market in drilling. Even in countries with totally planned economics, they are not yet unanimously successful after quarter of a century of active industrialisation and the succession of several "generations" of models.

The causes for this are numerous and arise essentially from the difficulties and insufficiences which handicap each of the types employed up to the present time. Electrical driving forces were from beginning outdistanced by hydraulic energy, liquid, gaseous, or mixed. Alternating motors have been eliminated on the basis of practical experience. The types which have survived are; axial hydraulic turbines and a helicoidal motor derived from "capsulic" motors studied and patented in France a quarter of a century ago by Monsieur MOINEAU, the latter in its simplest form, that of a monohelicoidal shaft rotating within a body in the form of a double helix.

However, none of these motors is able to fulfil all the requirements of the drillers nor do they offer the universality of the conventional methods termed "rotary".

Turbines require the quasi permanent presence of qualified technicians for their use and maintenance. They are costly and fragile. A complete set of turbodrilling machines includes several dozens of models with different diameters and lengths. In the course of the development of the power deployed in the continual progress of "rotary" equipment, motors have been produced which are more than 25 meters in length and which may contain more than 400 turbine stages. The most serious difficulty is the incompatibility of drilling tubrines with the parameters dictated by the rock bits. They are too fast for roller bits and too slow for diamond bits. They are also not easily compatible with the high pressures required with certain modern tools.

The difficulties of the helicoidal motors produced up to the present time are hardly less serious. The independence between the flow rate and the pressure drop, which separately control the speed of rotation and the torque, produces as many advantages as inconveniences. In particular it eliminates the possibility of auto-regulation.

The nutation of the shaft in the inverse direction to its rotation, at a speed multplied by the number of teeth in the rotor, has led to the driving of the rock bit through the intermediary of a cardan shaft, with all the inconveniences which this entails. The absence of circulation through the motor when stopped, that is to say while running in and out, has made it necessary to include a relief valve opening into the annular space, which causes permanent losses of power. Finally, the most serious result is the excessive lengthening of the shaft and the stator, entailed by the adaptation of the chosen type of motor to the hydraulic parameters available on a drilling rig. In sum these effects have the result that the upper limits of the obtainable power lay below the values which can already be transmitted to the tool by the "rotary" method and the use of volumetric motors has thus been restricted to operational tasks of short duration and low power, such as sidetracing operations. But, even in such uses, they are, as well as turbodrills in general, still too long to ensure optimal deviation gradients and only represent a makeshift.

One object of the invention is to provide a process for selectively driving an earth-boring tool such as a bit, a milling cutter, a core barrel or like tool, with a slow or a fast rotating speed, respectively, from one and the same driving unit, comprising the steps of using a driving unit comprising a shaft and a body constituted by two helicoidal gears arranged within each other, which provide an encapsulation of dextrorsum or right-handed, or left-handed pitch and having K and K+1 teeth, respectively, axially connecting the driven tool with the rotatably mounted body, or keeping the shaft angularly fixed but free to undergo a nutation movement in such a way as to produce a reduced driving speed corresponding to the relative speed of rotation between the said body and the said shaft, and keeping the body angularly and radially fixed, connecting the tool with the helicoidal shaft of the driving unit through a crank system and supporting the said helicoidal shaft in such a way that it can freely rotate about the said crank, which it drives by its nutating movement in order to produce a fast speed.

Another object of the invention is to provide a downhole motor for the above-mentioned process, comprising at least one driving unit having a shaft and a body constituted by two helicoidal gears arranged within each other, comprising K and K + 1 teeth, respectively, located and mounted with respect to each other so as to create an encapsulation having a right-handed or left-handed pitch, means for selctively mounting the said shaft in order that it is angularly fixed, but free to undergo a nutating movement, for rotatably supporting the body and for connecting the said tool with the said body, in order to produce a slow driving speed, and means for selectively mounting the said body in order that it is angularly and radially fixed and for supporting the said shaft for undergoing a nutation and rotation movement, and a crank system for connecting said tool with said shaft in order to produce a fast driving speed for said tool.

In the preferred form, the driving unit, for a determined outer diameter, is based on a helicoidal body and shaft, advantageously with multiple teeth, the length of which corresponds to the minimum power acceptable for the shortest engine and the constructional parameters of which are chosen in such a way that their speed of rotation lies, for normal flows, within the range of motors termed slow, while the speed of nutation lies in the range of motors termed fast.

With current diameters of deep petroleum borings, the slow speeds lie below 300–350 r.p.m. and fast speeds above 800–1000 r.p.m.

The pitches of the body and the shaft are preferably dextrorsum (right-handed) and the shaft advantageously has a length of the order of two pitches.

As indicated above, the method and the motor according to the invention make it possible to obtain speeds of two types.

In order to constitute a "slow" elementary motor the shaft is suspended in such a manner that it is angularly immobile, to organs which produce a flexible or articulated cardan joint suspension, so as to allow nutation, while the body, which is mounted, for example, on bearings centered on the axis of the engine, is able to turn to the right, driving the tool to which it is axially connected.

In order to constitute a fast elementary motor, the nutating shaft is, as follow from the foregoing, mounted as a crank on the axis of symmetry of the motor, in such a way that it can turn freely about the crank during its rolling within the interior of the body, which is fixed angularly and radially, the said shaft thus driving the tool, which is itself mounted on a driving shaft connected to the crank and coaxial with the motor.

In order to be able to construct slow or fast motors with higher power, as many driving units or elementary motors as are desired, are coupled axially. Such axially coupled units may or may not be identical, in particular, according to whether the fluid is incompressible or compressible.

According to a detail of the invention, the shaft of the said motor is advantageously pierced by a circulation channel fitted with a valve, or with a system of valves and/or nozzles, the valve or valves having the object of fixing the limits of the pressure drop within the driving unit, and thus the driving torque, while the nozzles allow a bypass to be created so as to fix independently the flow through the motor and the total flow having access to the tool.

The presence of such a bypass ensured through the shaft or else around the body also has the advantage of complementing or even replacing the relief valve which it is usual to provide above the engine, by creating, during running in and out or instrumentation, a direct passage for fluid between the drill stem and the annular exterior space. It also allows, in the case where an excess flow of fluid is available, the engine to be provided with an auto-regulation comparable to that which characterises the turbo-drilling motors termed slow.

The rotary bearings of the rotor body may be irrigated, according to another detail, by a bypass of the driving fluid current, as in conventional motors, but the method of assembly according to the invention lends itself advantageously to the installation of lubrication within an isolated chamber by a lubricant, since the only joint rotation under pressure is situated at the point of entrance of the fluid and thus allows the leakage of fluid to be drained towards the annulus.

According to yet another detail, in the case of fast motors, the rotating and nutating shaft is mounted directly on the driving shaft of the tool in an eccentric manner.

The attached drawings illustrate, in a non-limiting manner, some possible variants of assembly according to the invention employing the same type of shaft and body of the helicoidal motor.

FIG. 7 is a view similar to FIG. 1 showing another embodiment.

Figure 1:
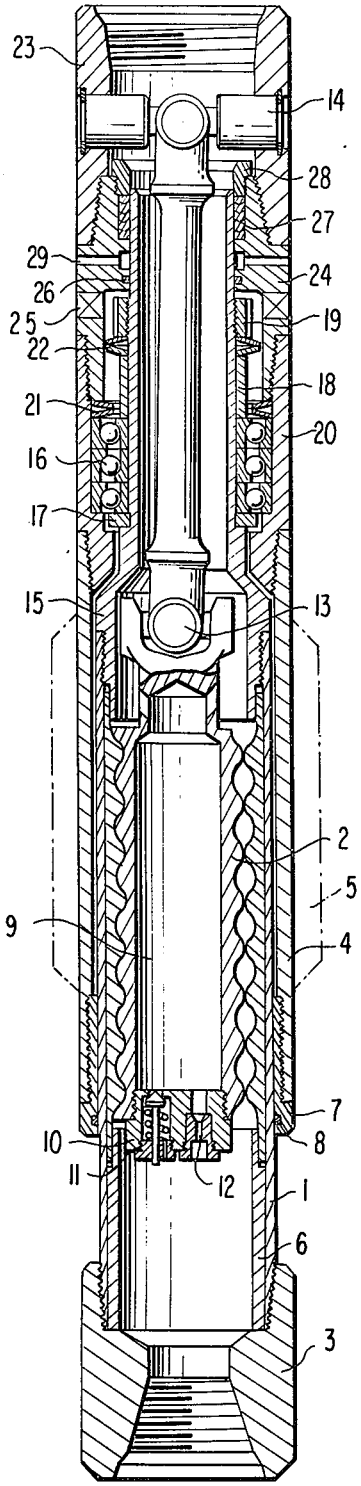
FIG. 1 illustrates, in section, the assembly of a single slow motor with a rotating body and a nutating shaft suspended on a cardan joint shaft.

Referring to FIG. 1, the reference number 1 indicates the helicoidal body of the subsurface motor, the number of "teeth" of which is greater by one than that of the helicoidal shaft 2 of the motor and which, in the case illustrated, is constituted, by a cylindrical tubular case normally provided on the inside with a helicoidal lining made from an elastomer. According to the fluids to be handled and the method of fabrication, the body may also be full metallic or alternatively its internal shape may, advantageously, prefigure the shape of the internal coating. The reference number 3 indicates the bit sub and the number 4 the exterior casing which prolongs the drill stem above the motor and which may, where necessary, be fitted with stabilizer blades 5.

A sealing jacker ensuring a seal between the elastic lining of the body and the body itself and reinforcing the body at the same time is indicated by 6. A bearing sleeve 7 is screwed into the lower end of the casing sheath, the said bearing sleeve being fitted in its interior with bearings which bear on the outer surface of the body 1 and with a rotating joint 8 which isolates, with equalisation of pressure, the annular space filled with lubricant, which is provided between the body 1 and the casing sheath 4.

The shaft 2 has an axial circulation channel 9 which is at the lower end fitted with a plug 10, bearing a valve shown schematically at 11 which can be controlled by means well known in themselves in such a way as to limit to a maximum and/or minimum the pressure drop across the driving unit, as well as a flow regulation nozzle shown schematically at 12 which can be constructed so as to provide a constant flow or a distribution, according to a given ratio, between the driving flow and flow diverted through the nozzle 12.

The shaft 2 is suspended through an intermediate cardan joint shaft indicated by I3 and a non-rotary suspension system 14 which accepts tensile stress, supporting the axial thrust acting on the shaft.

The body is suspended by a coupling-sleeve represented in a simplified manner at 15, which includes at least one axial-radial bearing such as 16 interposed between a screwed supporting ring 17 and a spacer 18 maintained on the shaft side by a nut 19. This coupling 15 is introduced into another coupling 20 connecting the casing 4 with the drill-stem.

Elastic elements constituted, for example, by washers of the Belleville type and indicated by 21 and 22, ensure the locking compression necessary in the bearing and allow, in the case where an abnormally high tractional force has to be exerted on the tool, the limitation of the repercussions of this traction by transferring it, above a certain value, directly to the drill stem through the intermediary of the ring 17 which is axially locked, for example screwed, on to 15 and which comes to rest against a shoulder formed at the base of the coupling 20.

The coupling 20 is connected to an upper sub 23 by another coupling 24 fitted in its lower part with a device 25, well known in itself, for the equilibriation of pressure in the lubricating reserve of the rotating part which, at this level, is isolated rotatively from the surrounding fluid with equalised pressure, by a joint 26.

It will be noted that, in the case in which the joints 8 and 26 lose their tightness, the system will return to a conventional lubrication by the irrigation fluid. It is, however, possible and advantageous to arrange labyrinths within the course of the annular space to increase the pressure loss, which will bring about an increase in the lifetime of the bearings.

A rotating packered joint such as 27, 28 ensures a seal between the rotating assembly and the casing. This joint acts under the same conditions of pressure and speed of rotation as the joints of the rotary swivels. If a leak appears, it is drained directly to the annular space by drainage channels denoted by 29, so as to avoid any excess pressure on the joint 26.

In the case of particularly severe working conditions, it is always possible to complete the seal at the level of the joint 27 by a system such as labyrinths for the pressure loss between the joint 27 and the orifices 29.

The mode of operation of the slow elementary motor illustrated in FIG. 1 will be easily understood by reading the preceding description. The nutating shaft 2, being angularly fixed and having a right hand pitch, the body 1 undergoes, by the action of the current of fluid, a rotary movement in the righthanded sense, driving the tool through the sub 3. Given that this movement simply corresponds to the rotation of one element of the motor relative to the other, by their meshing with one another, a slow driving speed for the tool is produced, as desired.

Inspection of FIG. 1 makes it clear that the possibilities for mounting and dismounting are varied and lead to simple designs, having emergency solutions in reserve to deal with blockages, jamming, or balling up.

It can also be seen that any breaking or unscrewing taking place above the body 1 allows the disconnected parts, which will remain to the whole, to be recovered.

In the case in which the conditions of use require total security, it is easy to ensure the axial solidarisation of the components 3 and 6 and, on the basis of this, of the body 1 with the base of the shaft 2, and in manner such that connections or disconnections can be made from below during assembling or disassembling.

As shown in FIG. 1, the profile of the driving shaft of the motor requires an exterior constriction between the sub 3 and the casing 4. In the case in which the ratio of the diameters of the motor and of the hole to be drilled make this constriction undesirable on account of the hydraulic perturbations caused in the annular space, it can easely be masked according to the technique described in the first addition No. 70,072 attached to French Patent No. 1.157.162, letting the sub 3 assume the role of the sub 13 in FIGS. 1 and 2 of this Patent, which at the same time increases the moment of inertia of the rotating part. It is obvious that the various details of mounting shown in the Figure can be replaced by equivalent devices without departing from the invention.

For example, the thrust and radial bearings may include any type of roller or smooth journal bearings and be lubricated by the fluid flow or by a bath of lubricant and the suspension may be achieved by means other than a cardan joint, etc...

Figure 2:
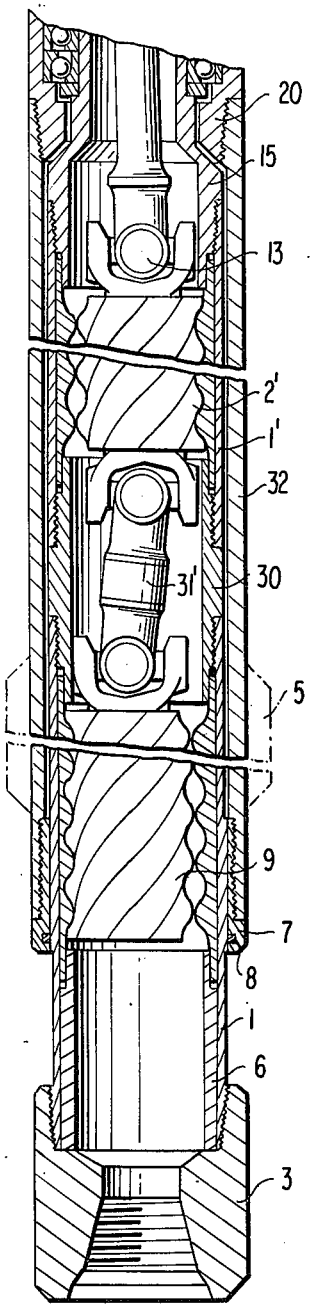
FIG. 2 illustrates a slow motor with multiple driving units.

FIG. 2 shows a motor of the same nature but of a multiple type.

The reference numbers 1 to 20 here indicate parts similar to those shown in FIG. 1; but the motor is made up of two or more similar motor assemblies, such as 1,2; 1′, 2′; coupled axially by coupling sleeves such as that denoted by 30, the shafts 2,2′ etc... of the said motors being linked together axially and angularly by means of articulated couplings indicated by 31, of length suitable to limit the angle between the axes of the parts 1, 1′, and 31.

The motor assembly rotates, as in the case illustrated in FIG. 1, in the interior of a casing 32 of suitable length. It is important to emphasise that this method of assembly does not require any angular positioning of the bodies or shafts such as 1,2 etc... of successive driving units.

The bypassing circuits delivering through the helicoidal shaft are not illustrated in order to avoid complicating the Figure.

It will be noted that, given that each driving unit receives the whole of the flow and has an autonomous regulation circuit, the control of the flow pressure is much more certain and more adaptable than is the case where an attempt is made to increase the power by multiplying the number of pitches of a body and a shaft or simply by coupling a succession of driving units each receiving the full flow. In order that all the driving units shall turn at the same speed, it is necessary in fact that for each of them the flow passing between the body and the shaft shall be equal to the sum of the nominal flow corresponding to the speed plus a leakage flow which is a function of the initial adjustement and of the wear, a leakage which can vary considerabily from one driving unit to another.

Figure 3:
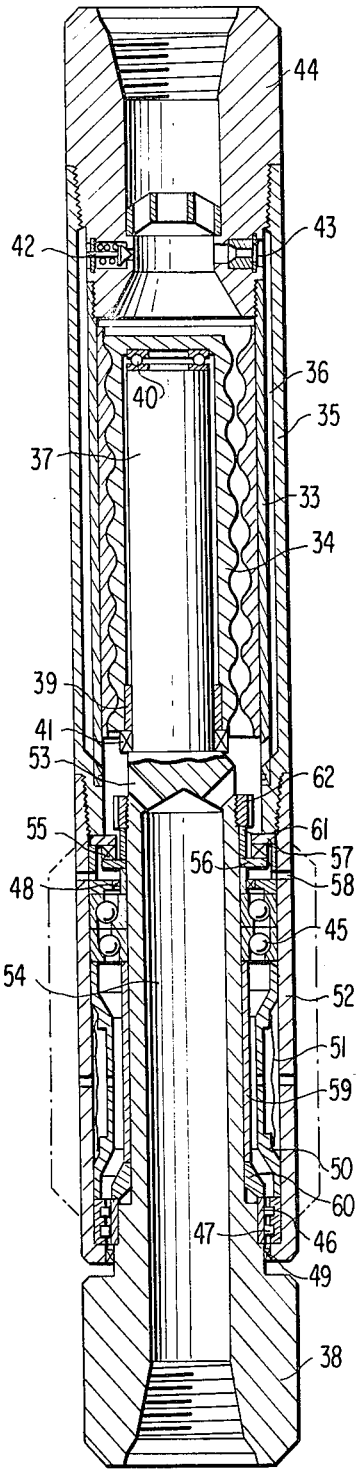
FIG. 3 illustrates a single fast motor with a casing and an annular bypass.

FIG. 3 illustrates the mounting of a fast single motor, using a helicoidal body 33 and a corresponding shaft 34, having the same characteristics as the body 1 and the shaft 2 of FIG. 1.

In this case, the body is set in a casing 35 in a fixed manner and the bypass is, in the case illustrated, ensured by an annulus 36 present between the elements 33 and 35. The helicoidal shaft 34 is mounted in a rotating manner on an eccentric crank 37 linked rigidly to the shaft 38 which drives the tool which is coaxial with the motor. This mounting is illustrated schematically here by a radial bearing 39, a thrust bearing 40 intended to support the axial thrust, and a rotating packer 41. Devices for compensation and supplying a reserve of lubricant (not illustrated) can be advantageously arranged inside the crank 37.

As in the case illustrated in FIG. 1, the bypassed current passing through the annulus 36 is, as at 11 and 12, controlled by a valve 42 and, where necessary, by a nozzle shown schematically at 43 and situated, in the mounting described, in the upper sub 44.

The guiding of the driving shaft 38 is here represented in the form of an axial-radial bearing made up from ball bearings such as 45 and from a radial roller bearing 46, 47 operating in a lubricant bath isolated from the surrounding fluid by seal rings 48 and 49 maintaind at equipressure by a membrane regulator such as that shown schematically at 50, 51, equilibrated with the exterior pressure through orifices in the guiding sleeve 52 which extends the casing 35 of the motor.

The driving flow evacuated through the orifices 53 and the channel 54 towards the rock drill is isolated from the radial bearing by a rotating seal ring 55 mounted between the shoulder rings 56, 57, any leakage flow which occurs being evacuated towards the annular space by drainage holes 58.

The rotor pile 46, 60, 59, 45, 56, and 61 is locked but a nut denoted by 62.

As before, the mode of operation of this motor is easily understood. The body 33 of the motor being fixed, the shaft 34 performs a rotation and a nutation movement simultaneously. The rotation takes place "meshing" between the teeth of the body and those of the shaft. During its nutation the shaft transmits its movement, through the intermediary of the crank 37, to the tool connected to the crank by the shaft 38. Given that this nutation occurs at a speed equal to the product of the speed of rotation and the number of teeth k of the shaft, a fast driving speed of the tool is produced.

Figure 4:
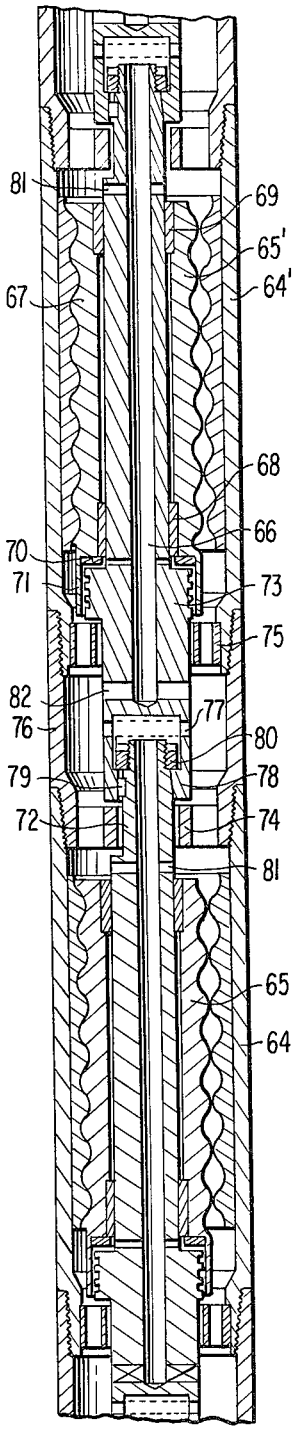
FIG. 4 illustrates a multiple fast motor of reduced outer diameter with the helicoidal body acting as the casing and an axial bypass.

FIG. 4 illustrates the method of axial coupling of several driving units, indicated by 64 and 65, and this Figure illustrates the case in which the stator bodies 64 themselves act as the casing, thus reducing the external diameter, while the bypass channel runs through an axial boring 66 in the nutating helicoidal shaft.

The assembly is constituted by a driving shaft similar to that shown in FIG. 3, to which are coupled a succession of two or more driving units the helicoidal shafts of which 65,65' etc... are mounted rotatably and are thrust on to cranks 67 guided by radial bearings 68 and 69 and supported by thrust bearings shown here schematically at 70 which are irrigated by a leakage flow passing through the annular space produced between the shaft 65 and the crank 67 and regulated by baffles indicated by 71, the diameter of which is as close as possible to that of the rotor in order to compensate the axial thrust.

Each crank includes a driving shaft coaxial with the body, represented respectively at the two extremities by the sections 72 and 73 which are guided radially by the radial bearings 74 and 75.

Coupling of the bodies is produced by screwing on for example by means of couplings 76, while the shafts are supported by thrust bearings and are connected rigidly, in the angular sense, by known means such as a direct drive dog clutch 77 formed in the extremity 73 of the shaft and a dog clutch cap 78 which is splined at 79 and is locked by a nut 80 on the upper threaded section 72 of the crank shaft.

The bypass circulation takes place, as indicated above, through a boring 66 in the crank which communicates with the fluid flow through orifices 82 which may, as in the case of the slow motors, be connected to valves and nozzles.

Figure 5:
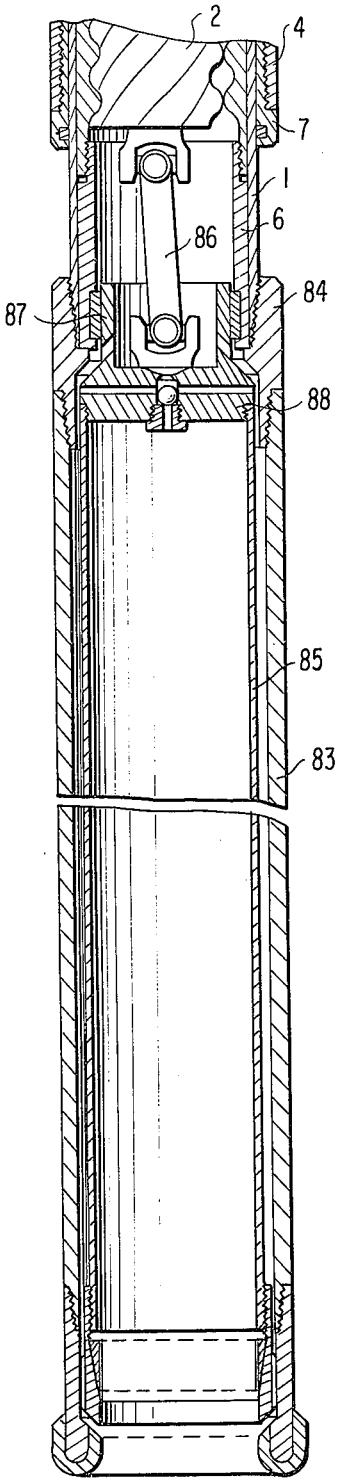
FIG. 5 shows the way of coupling a double barrel core drill to a slow motor.
Figure 6:
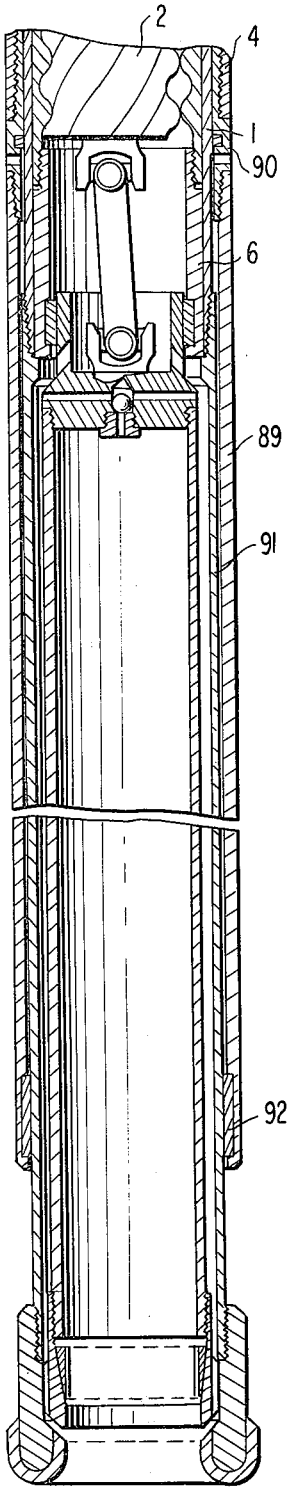
FIG. 6 shows in the same way the coupling for a triple core drill.

FIGS. 5 and 6 illustrate the particularly advantageous application of a slow motor such as that shown in FIGS. 1 and 2 to the drive of core drills.

Inspection of FIG. 1 shows that it is sufficient to connect the outer tube 83 of a double core barrel through the intermediary of a suitable sub 84 to the rotation body of the motor and to lock the inner core tube angularly by connecting it by means of an articulated coupling such as that shown at 86 to the nutating helicoidal shaft in order to produce a core barrel with an angularly fixed core tube. In the case of FIG. 5 the inner tube is suspended on the cardan joint shaft and is guided by the collar 87 of the inner tube plug 88, within the sleeve 6 which acts as a radial bearing.

An advantageous variant consists in suspending the inner core tube, free to rotate, in a known swivel manner by means of a thrust bearing in the upper outer tube sub, which makes it possible to employ a cardan joint shaft, with a sliding, groove connection which makes the coupling and uncoupling of the core barrel particularly easy.

The method of assembling shown in FIG. 6 differs from the above only by the presence of a guiding case 89 angularly fixed to the casing 4, which it is connected by an elongated radial bearing sub. The guiding of the rotating outer tube 91 of the core barrel is shown schematically by the radial bearing 92, lubrication of which can be assured by a leakage flow maintained in the annulus formed between the parts 89 and 91.

In FIG. 7, which shows an embodiment similar to the one illustrated in FIG. 1, the rotating body of the motor has been shown at 101. Within said body is secured by known means a sheath 102 carrying, internally, ann helicoidal lining, more particularly made of an elastomer, in order to constitute the driving part of the motor. Said body 101 is connected through a thread 103, which is here of the cylindrical type, to a lower shaft 104, whereby said thread is combined with a conical bearing surface 105 which is shrunk on the corresponding part under an oil pressure when assembling the motor.

At its other end, the lower shaft 104 supports the bit sub 106. The coupling comprises a conical thread 107 and a conical bearing surface provided by a conical inerposed sleeve 108. Also in this case, the conical bearing surface is assembled by a shrunk-on fit through an oil pressure.

Reference numeral 109 is the motor lower bearing, comprising a smooth bushing 110 and a wear sleeve 111 locked on the shaft 104. A suitable arrangement of the irrigating grooves (not illustrated) which are cut in the bushing provides a viscosity pump exerting an overpressure on the lower sealing ring 112 of the said lower bearing, in order to impede penetration of the driving fluid under the said sealing ring.

As illustrated on the drawing, the lower shaft 104 of the motor comprises a bore 113 ending at its lower end with an hexagonal shaped profile 114. it is thus possible to lock the bit sub 106 onto the shaft 104 while holding the said shaft from its inner surface through the hexagonal profile 114. The outer surface which is otherwise required externally for a wrench at the end of the shaft 104 can thus be spared and the motor can be made shorter.

As illustrated, the motor comprises an hollow shaft 115 provided externally with an helicoidal profile cooperating with the helicoidal lining of the motor body 101 in order to drive said body. The bore 116 of the helicoidal shaft 115 is closed at its lower end through a security system. In the present embodiment, said system is made of a cylindrical block 117 which is removably insertable from below into the bore 116 of the helicoidal shaft 115 and which can be removably secured through a bayonet coupling 118, whereby said coupling is locked through a spring 119. The elements of the security block, i.e., the valve and nozzle are not illustrated for simplification. They can be of the type disclosed in connection with FIG. 1. A sealing ring 145 is provided between the security block and the shaft 115.

As disclosed in connection with FIG. 1, the helicoidal shaft 115 is suspended through a cardan joint 120 to a countershaft 121 which itself is suspended to an upper cardan joint 122. In the present embodiment, a flange 123 of the upper cardan joint is angularly secured through screws 124 on a bell-shaped member 125 which provides for the suspension of the assembly made of the cardan shaft 120–122 and the helicoidal shaft 115 within the motor. The bell-shaped member 125 is secured through keying means or flutes within the upper sub 126 of the motor, which is connected in a usual way to the drill stem. Moreover, the said bell-shaped member is axially pressed against a shoulder of the said upper sub through pressure exerted by resilient washers illustrated at 127. The upper sub 126 is connected through a conical thread with another sub 129 surrounding the upper bearing of the motor and which itself is connected to the fixed casing 130 of the motor. The casing 130 supports at its lower end the body of the lower bearing 109.

Reference numeral 131 is the oil membrane reservoir, the pressure of which is maintained in equilibrium with the pressure in the outer annular space through holes such as 132 provided in the casing 130.

The upper seal for the motor is provided by a packer 133 comprising wear elements and a sealing ring 134 which are mounted within a member 135, removably secured within the sub 129 through a thread portion 136. This assembly makes its possible to replace the wear elements of the packer without dismantling the motor.

It is seen in FIG. 7 that the wear tube 137 cooperation with the packer is mounted in an angularly fixed but axially resilient manner with respect to the rotor assembly of the motor, as illustrated at 138.

The said rotor assembly is located within the sub 129 and is mounted through a thrust bearing and upper radial bearing system, whuch comprises in the present instance ball and roller thrust bearings 139 and a cylindrical radial bearing 140. The ball thrust bearings 139 comprise resilient members such as 141 and the assembly made of the said thrust and radial bearings is secured through a nut 142, a counternut 143 and a brake 144.

The operation of the thus described embodiment is the same as the one corresponding to the embodiment illustrated in FIG. 1.

The preceding description shows that the technique which forms the object of the invention makes it possible to constitute, starting from a single type of motor parts, that is a body and shaft, a complete range of underground motors covering and exceeding practically all operating parameters of existing motors and, in particular, having a higher specific power per unit of length.

The whole range of the assembling techniques according to the invention makes it possible to construct extra short single motors, particularly adapted to side-tracking, and multiple, coupled higher power motors, as well within the range of speeds termed slow, as within the range of high speeds.

The various improvements illustrated in the examples show that motors according to the invention combines a maximum of the advantages of the various existing types of motor.

Modifications may be made to the modes of operation described, within the field of technical equivalence, without departing from the invention.

For instance, it is obvious that, if it is desired to produce motors according to the invention to drive a tool in left-handed rotation, it is sufficient to employ a body and shaft with a left-handed pitch (sinistrorsum).

What is claimed is:

1. Downhole motor for driving an earth-boring tool, supported from a drill stem and comprising a helicoidal shaft and a tubular body having a helicoidal lining, said shaft and body comprising two helicoidal gears located within each other, comprising K and K+1 teeth respectively, arranged for creating an encapsulation of a given pitch direction, said shaft being located within said tubular body, means for mounting said shaft in order that it is angularly fixed, but free to undergo a nutating movement, a casing rigidly secured to said drill stem, upper and lower radial bearing means and thrust bearing means for rotatively mounting said body within said casing, means for connecting said tool with said rotating body, and means for supplying a driving fluid between said shaft and said tubular body.

2. Downhole motor according to claim 1, comprising a lower shaft extending downwardly from said rotating body, said tool being connected with said lower shaft, said lower radial bearing being arranged underneath said lining and surrounding said lower shaft.

3. Downhole motor according to claim 1, comprising a lower shaft extending downwardly from said rotating body, said tool being connected with said lower shaft, and threaded connecting means and shrunk-on fit zones for connecting said lower shaft with said body on the one hand, and said tool with said lower shaft on the other hand.

4. Downhole motor according to claim 1, comprising a lower shaft extending downwardly from said rotating body, said tool being connected with said lower shaft, said lower radial bearing means surrounding said lower shaft, sealing means provided at the lower end of said lower radial bearing means, and a viscosity pump arranged within said radial bearing means for creating an overpressure on said lower sealing means.

5. Downhole motor according to claim 1, comprising a lower shaft extending downwardly from said rotating body, said tool being connected with said lower shaft, a non-circular hollow portion arranged at the lower end of said lower shaft for receiving a wrench or like tool, and wrench-receiving surfaces provided on said earth-boring tool.

6. Downhole motor according to claim 1, comprising sealing means provided at the lower end of said lower radial bearing means, and a viscosity pump arranged within said radial bearing means for creating an overpressure on said lower sealing means.

7. Downhole motor according to claim 1, comprising a bore provided 9 in said helicoidal shaft and having an upper and a lower end, passages provided at the upper end of said bore and connected to said fluid supplying means, a security block removably inserted within said lower end of said bore, valves and nozzles arranged within said security block, and coupling means for coupling said security block with said shaft.

8. Downhole motor according to claim 1, comprising a bore provided in said helicoidal shaft and having an upper and a lower end, passages provided at the upper end of said bore and connected to said fluid supplying means, a security block removably inserted within said lower end of said bore, valves and nozzles arranged within said security block, a bayonet coupling system for coupling said security block with said shaft, and resilient means for locking said bayonet coupling system in an assembled condition.

9. Downhole motor according to claim 1, wherein said driving fluid supplying means comprises packing means spaced from said first sealing means, and drain holes connecting said space between said packing means and said first sealing means with the outer annulus of the borehole.

10. Downhole motor according to claim 1, comprising tubular means angularly rigid with said body, having a lower end secured to said body and an upper end, first sealing means arranged near said upper end of said tubular means, above said upper bearing means and beneath said driving fluid supplying means, second sealing means provided at the lower end of said body beneath said lower bearing means, an oil reservoir of variable volume having an outer surface provided between said first and second sealing means, and passage means for connecting said outer surface of said oil reservoir with the outer annulus of the borehole for maintaining the pressure within said motor in equilibrium with the pressure in said outer annulus.

11. Downhole motor according to claim 10, comprising a viscosity pump arranged within said radial bearing means for creating an overpressure on said lower sealing means.

12. Downhole motor according to claim 10, comprising valve means connected to said oil reservoir for limiting the overpressure within said oil reservoir.

13. Downhole motor adapted for connection to a tubular conduit for driving an earth boring tool comprising:

an external casing having upper connector means for attachment to said tubular conduit;

shaft means mounted within said casing and having a helicoidal external surface with at least one tooth;

means for mounting said shaft means within said casing in such a way that said shaft means is prevented to turn relative to said casing and free to nutating movement;

a tubular rotatably mounted within said casing around said shaft means and comprising a helicoidal internal surface with one more tooth than said external surface, said internal surface being intermeshed with said external surface, said body having lower connector means for rigidly securing said earth boring tool;

upper and lower bearing means for rotatably journalling said tubular body within said casing, with at least a portion of said internal helicoidal surface located between said upper and lower bearing means; and means for directing a driving fluid between said body and said shaft means to produce rotation of said body.

14. The downhole motor of claim 13 further comprising upper and lower sealing means between said body and said casing for defining an enclosed chamber containing a lubricating fluid between said body and said casing, said upper and lower bearing means being located within said chamber.

15. The downhole motor of claim 14 further comprising pressure balancing means for maintaining the pressure within said chamber in equilibrium with the ambient pressure outside said casing.

16. The downhole motor of claim 15 further comprising viscosity pumping means for applying an overpressure in said chamber on at least one of said sealing means.

17. The downhole motor of claim 13 wherein said fluid directing means comprises packing means between said body and said casing, said casing having passage means below said packing means for draining any driving fluid leaking through said packing means to the exterior of said casing.

18. The downhole motor of claim 13 wherein said body comprises at least two tubular members secured by threaded and shrunk-on fit zones.

* * * * *